US005969687A

United States Patent [19]

Podger

[11] Patent Number: 5,969,687

[45] Date of Patent: Oct. 19, 1999

[54] DOUBLE-DELTA TURNSTILE ANTENNA

[76] Inventor: James Stanley Podger, 55 Gradwell Drive, Scarborough, Ontario M1M 2N1, Canada

[21] Appl. No.: 08/785,813

[22] Filed: Dec. 28, 1996

[30] Foreign Application Priority Data

Mar. 4, 1996 [CA] Canada ..... 2170918

[51] Int. Cl.[6] ..... H01Q 11/12

[52] U.S. Cl. ..... 343/742; 343/792.5; 343/806; 343/808

[58] Field of Search ..... 343/741, 742, 343/866, 867, 890, 891, 742.5, 806, 807, 808, 809, 810, 811, 812, 813; H01Q 11/12

[56] References Cited

U.S. PATENT DOCUMENTS

| | | | |
|---|---|---|---|
| D. 213,375 | 2/1969 | Habig | D26/14 |
| 1,790,646 | 2/1931 | Alexanderson | 250/11 |
| 2,210,491 | 8/1940 | Lewis | 343/891 |
| 2,304,446 | 12/1942 | Eaton | 343/867 |
| 2,510,290 | 6/1950 | Masters | 343/892 |
| 2,537,191 | 1/1951 | Moore | 250/33.67 |
| 2,615,005 | 10/1952 | White | 250/33.57 |
| 3,268,899 | 8/1966 | Walden | 343/741 |
| 3,434,145 | 3/1969 | Wells | 343/726 |
| 3,646,566 | 2/1972 | Neff | 343/808 |
| 4,180,820 | 12/1979 | Johns | 343/890 |

FOREIGN PATENT DOCUMENTS

| | | | |
|---|---|---|---|
| 62-206903 | 9/1987 | Japan | H01Q 19/28 |
| 63-138803 | 6/1988 | Japan | H01Q 7/00 |
| 806120 | 12/1958 | United Kingdom . | |

OTHER PUBLICATIONS

Grammer, George, "Technical Topics, The Quad Antenna," *QST,* Nov. 1948, pp. 40–42.

Sykes, B., "The Skeleton Slot Aerial System," *The Short Wave Magazine,* Jan. 1955, pp. 594–598.

Davey, W. W., "Try A Bi–Loop Antenna," *73 Magazine,* Apr. 1979, p. 58.

Hawker, J. Patrick, "Technical Topics, Double–Delta Aerials for VHF and UHF," *Radio Communications,* Jun. 1969, pp. 396–397.

Tsukiji, Takahiko and Shigefumi Tou, "High–Gain, Broad–Band Yagi–Uda Array Composed of Twin–Delta Loops," *Antennas and Propagation, Part 1: Antennas,* I.E.E.E. Conference Publication No. 195, 1981, pp. 438–441.

Tsukiju, Takehiko et al, "Twin Delta Loop Antenna and Its Application to Antenna with Plane Reflector," *Electronics and Communications in Japan,* part 1, vol. 68, No. 11, pp. 96–104.

Tsukiju, Takehiko and Yasunori Kumon, "The Crossed Twin–Delta–Loop–Antennas with Different Peripheral Lengths," *Proceedings of The 1985 International Symposium on Antennas and Propagation,* Japan, pp. 481–484.

Belrose, John, "Technical Correspondence, A Half Twin–Delta Loop Array," *QST,* Apr. 1983, pp. 39–40.

Masters, R. W., "The Super Turnstile," *Broadcast News,* Jan. 1946, pp. 42–44.

Sykes, B., "The Skeleton Slot Antenna," *CQ,* Aug. 1960, pp. 52–53, 122.

(List continued on next page.)

*Primary Examiner*—Hoanganh Le
*Assistant Examiner*—Tho Phan

[57] ABSTRACT

This antenna has two sets of conductors. Each set is two coplanar triangles with a corner from each triangle at the center and with the two triangle sides opposite those corners being positioned parallel to each other. The planes of the two sets are perpendicular to each other, with the junction of the two planes being close to the imaginary lines through the centers of the parallel sides and the centers of the sets. If the two structures were fed so that the currents in corresponding parts were equal in amplitude and different in phase by 90 degrees, a horizontally polarized omnidirectional radiation pattern would be obtained. Such an omnidirectional antenna would have more gain than a turnstile array of half-wave dipoles with less wind resistance than a Masters super turnstile antenna.

12 Claims, 3 Drawing Sheets

OTHER PUBLICATIONS

Orr, William I., "Loop Configuration," *Radio Handbook,* 23rd ed. (Indianapolis: Howard W. Sams & Co., 1987), pp. 22–11/12.

Habig, Harry R., "The HRH Delta–Loop Beam," *QST,* Jan. 1969, pp. 26–29.

Kraus, John, "Superturnstile Antenna," *Antennas,* 2nd ed. (New York: McGraw–Hill Book Company, 1988), pp. 729–731.

Prior Art
Fig. 2
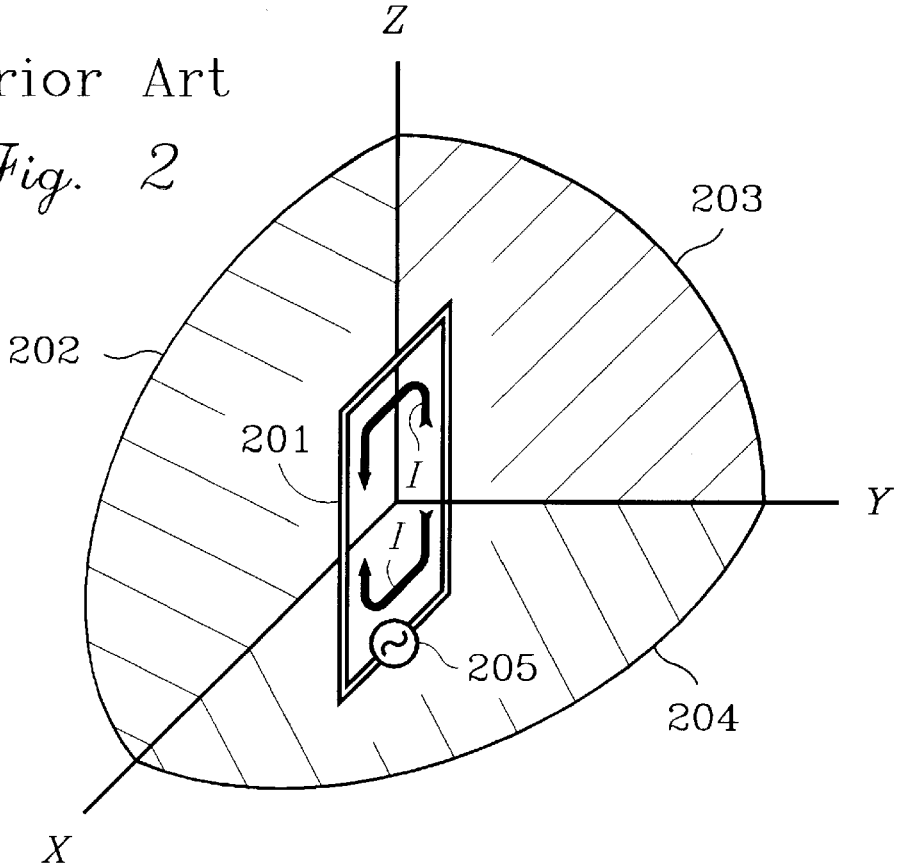
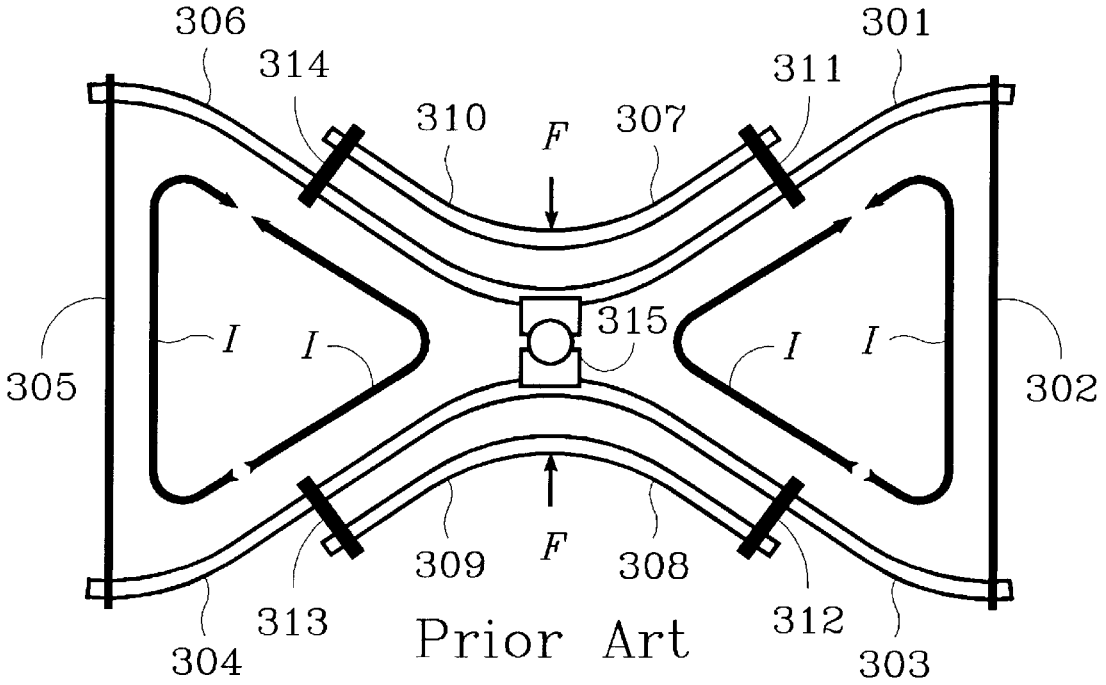
Prior Art
Fig. 3

DOUBLE-DELTA TURNSTILE ANTENNA

This application is the U.S. version of Canadian patent application 1,170,918.

FIELD OF THE INVENTION

This invention relates to antennas, specifically antennas designed to provide horizontally polarized radiation equally in all horizontal directions. Heretofore, low-gain arrays such the turnstile array of half-wave dipoles or the higher-gain Masters super turnstile antenna have been used. A problem with the Masters antenna is that it has a relatively high wind resistance. This disclosure presents an antenna that provides such an omnidirectional performance with more gain than arrays of half-wave dipoles without the high wind resistance of the Masters super turnstile antenna.

LIST OF DRAWINGS

The background of this invention as well as other objects and advantages of the invention will be apparent from the following description and appended drawings, wherein:

FIG. 2 illustrates the conventional principal planes passing through a rectangular loop antenna;

FIG. 3 illustrates an antenna structure having two approximate triangles with various construction features depicted.

PRIOR ART—ONE-WAVELENGTH LOOPS

Figure 1A:
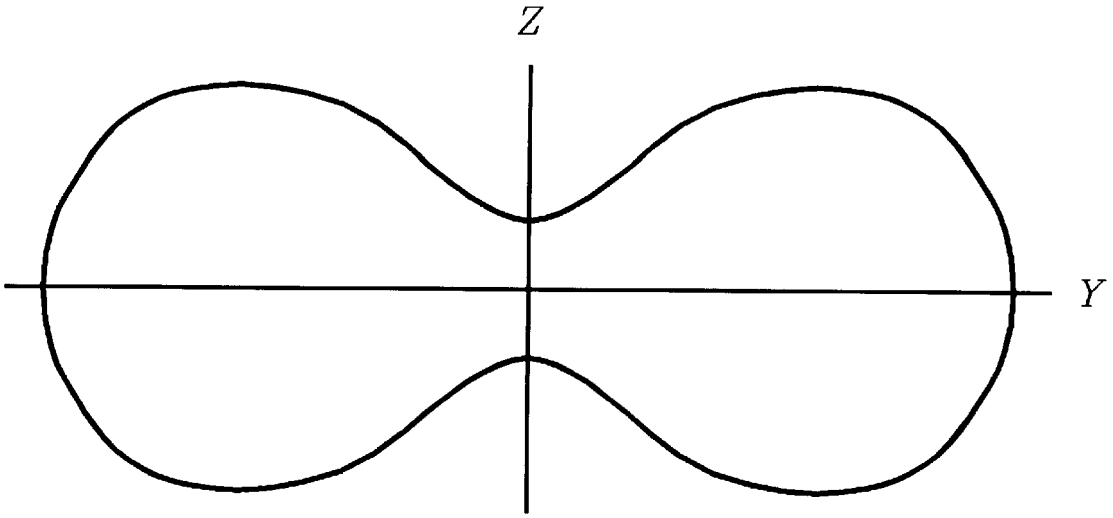
Prior Art Fig. 1A
FIG. 1A, 1B and 1C illustrate some possible simplified radiation patterns of antennas.

Because this invention relates to antennas having pairs of triangular loops of conductors approximately one wavelength in perimeter, it is necessary to review the prior art of such loops. There is a need to understand the advantages of loops, the further advantages of pairs of loops, and the further advantages of pairs of triangular loops. Once the benefits of such loops are understood, it is easier to understand the merit of the present invention.

Prior Art—Single Loops

The classical elementary antenna structure, called a half-wave dipole antenna, is a straight conductor approximately one-half of a wavelength in length. One of its disadvantages is that it transmits or receives equally well in all directions perpendicular to the conductor. That is, in the transmitting case, it does not have not much gain because it wastes its ability to transmit in desired directions by sending signals in undesired directions. Another disadvantage is that it occupies considerable space from end-to-end, considering that its gain is low. A third disadvantage is that it is susceptible to receiving noise caused by precipitation. Yet another disadvantage is that if a high transmitter power is applied to it, in some climatic conditions, the very high voltages at the ends of the conductor can ionize the surrounding air producing corona discharges. These discharges can remove material from the conductor ends and, therefore, progressively shorten the conductors.

It was mainly this last disadvantage that was a problem for Clarence C. Moore at short-wave broadcasting station HCJB, near Quito, Ecuador. The solution he disclosed in his U.S. Pat. No. 2,537,191 was to use instead arrays of antenna structures consisting of square, rectangular or circular two-turn loops of conductors about one wavelength in perimeter. Although his patent was for two-turn loops, news of his invention stimulated interest in single-turn loops.

To illustrate the advantage of one-wavelength single-turn loops, FIG. 2 shows the rectangular version of them. In addition to the lines representing conductors, FIG. 2, as well as FIG. 3, have wide, solid arrows that denote some aspects of the currents in those parts. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions. However, beside these notations of where the current maxima and minima would be located, not much else is denoted by these arrows. Particularly, one should not assume that the currents at the centers of all the current paths are necessarily of the same magnitude and phase as each other even though all of these currents are denoted as I. In general, the interaction of the currents will produce a complicated amplitude and phase relationship between these currents. Nevertheless, it would be unusual if the phase of these currents would be more than 90 degrees away from the phase implied by the direction of the arrows. That is, the phase would not be so different from an implied zero degrees that the arrows should be pointed in the opposite direction because the phase is closer to 180 degrees than to zero degrees.

Of course, these current directions are just the directions of particular currents relative to the directions of other currents. They all are obviously alternating currents which change directions at the frequency of operation.

As indicated by the generator symbol (205) in FIG. 2, if energy is fed into one side of the loop (201), maxima of current standing waves are produced at this feeding point and at the center of the opposite side of the loop, because it is a one-wavelength loop. The current minima and voltage maxima are half-way between these current maxima. Because the high-voltage points on such structures are not at conductor ends and the structures have lower Q's anyway, there are weaker electric fields around the high-voltage places and, therefore, less tendency to ionize the surrounding air.

Although this corona discharge usually is a problem only at high-altitude places, like Quito, the square, single-turn version of this antenna structure, commonly called a quad antenna, became popular for other reasons. First, the received precipitation noise is less with such loop antennas. Secondly, the radiation is not uniform in the YZ plane (203). This is because there are, in effect, two conductors carrying the maximum current, the top and bottom of the loop in FIG. 2, which are perpendicular to that plane. Although these two currents are approximately equal in amplitude and phase in this case, because of the symmetry, their fields would add in phase only in the direction of the Y axis. On the Y axis, the distance from those two conductors to any point is the same so the propagation delay is the same. In other directions, the distance travelled to any point would be different for the two fields, hence they would not add in phase. This nonuniformity is more pronounced if the loop is rectangular, instead of square, with the feed point in one of the shorter sides, as in FIG. 2. That is, the radiation pattern in that plane is similar in shape to that illustrated by FIG. 1A. Hereinafter, this plane (203) will be called the principal H (magnetic field) plane, as is conventional.

Figure 1B:
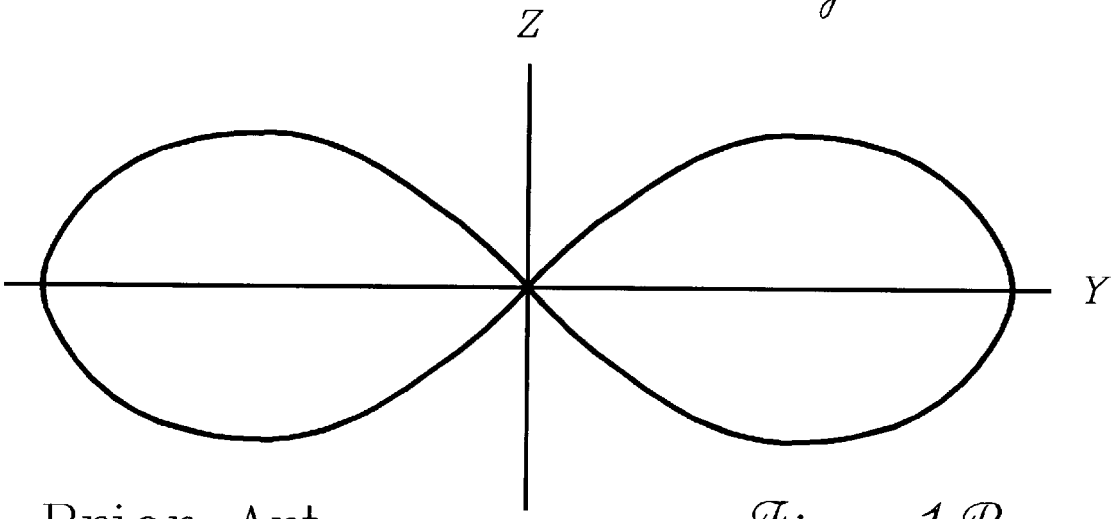
Prior Art Fig. 1B
Figure 1C:
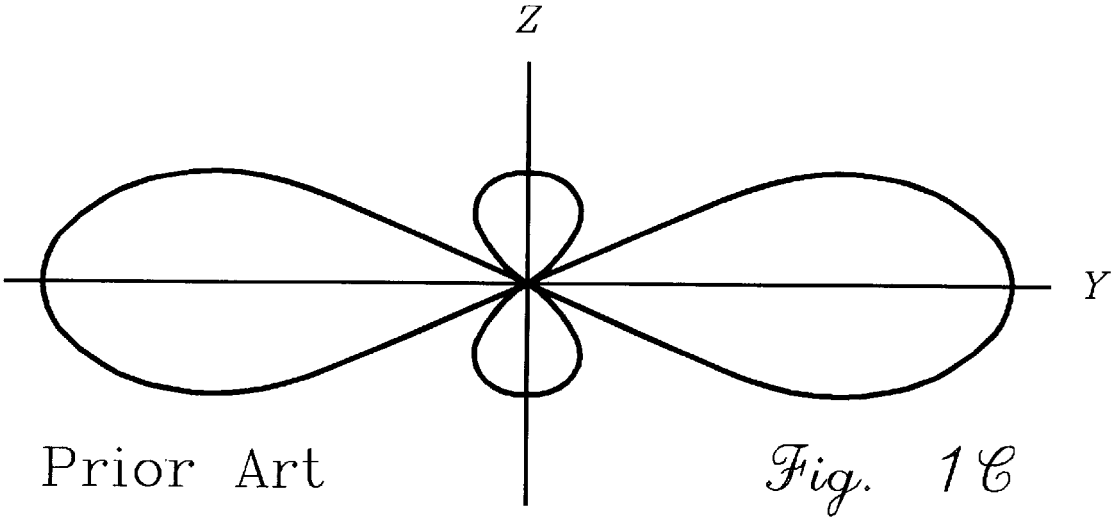
Prior Art Fig. 1C

Therefore, this structure has gain relative to a half-wave dipole antenna in the direction perpendicular to the plane of the loop, which is the Y axis of FIGS. 1 and 2. Also because of this nonuniform pattern, if plane 203 is vertical (horizontal polarization), signals transmitted at low angles to the horizon are somewhat stronger. This factor gave this antenna structure the reputation for being better if a high supporting tower was not available. Antennas located near the ground usually produce weak signals near the horizon.

This ability to produce stronger signals near the horizon is important in and above the very-high frequencies because signals generally arrive at angles near the ground. Fortunately, it is not difficult to put signals near the horizon at such frequencies because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

Another advantage of this structure is that the quad antenna is only one-half as wide as the half-wave dipole antenna and, therefore, it can be placed in smaller spaces. On the other hand, because its high-current paths are shorter than those of a half-wave dipole, a quad produces a slightly broader radiation pattern in the plane that is perpendicular to both the plane of the antenna (202) and the principal H plane (203). Hereinafter, this will be called the principal E (electric field) plane (204), as is conventional. This broader pattern reduces the antenna gain to a relatively small extent. The net effect is that the quad does not have as much an advantage in satellite applications, where sheer gain may be most important, as it does in terrestrial applications, where performance at low elevation angles may be most important.

Since 1948, there have been many articles and books on quads, such as George Grammer's article in QST in November, 1948. Other shapes of loops proposed include the triangle of J. D. Walden in U.S. Pat. No. 3,268,899, the better known delta loop of Harry R. Habig in U.S. design Pat. Des. 213,375, circles, and diamond-shaped loops. Mathematical analysis shows that circular loops are the best of these shapes and the triangles are the worst. However, the differences are small.

Prior Art—Pairs of Loops

More significant advances have been made using closely spaced pairs of loops, without losing the advantages of single one-wavelength loops. Because of the interaction of the fields, these combinations of two loops modify the magnitude and phase of the currents to an extent that makes the combination more than just the sum of two loops. The result is that the dimensions can be chosen so that the field patterns in the principal H plane can be like FIG. 1B or even like FIG. 1C. Such dimensions not only give more gain by narrowing the major lobe of radiation but, particularly in the case of FIG. 1B, the radiation in undesired directions also can be greatly reduced. In addition, some arrays of such two-loop combinations can reduce the radiation to the rear to produce very desirable unidirectional radiation patterns in the principal H plane. On the high-frequency bands, such radiation patterns can reduce the strength of high-angle, short-distance signals being received so that low-angle, long-distance signals can be heard. For receiving weak very-high or ultra-high-frequency signals bounced off the moon, for another example, such patterns will reduce the noise received from the earth or from stars that are not near the direction of the moon. Also, for communications using vertical polarization on earth, so that the principal H plane is horizontal, such radiation patterns would reduce the interference from stations located in horizontal directions different from that of the desired station.

Perhaps the first of these combinations was two rectangular loops with a common side developed in the 1940's by B. Sykes. He discussed this combination in his article in *The Short Wave Magazine* in January, 1955. Later, the following three combinations of two loops were proposed by D. H. Wells in U.S. Pat. No. 3,434,145: two circles, two separate squares, and two squares with a common side. More recently, W. W. Davey's combination of two diamond-shaped loops, with a corner of each loop at the center of the structure, was described in his article in 73 *Magazine* in April, 1979. However, the most important combination seems to be John Pegler's pair of triangular loops, with one corner of each loop at the center, which was disclosed by Patrick Hawker in *Radio Communications* in June, 1969. Mr. Hawker reported that Mr. Pegler had used arrays of such structures for "some years" on amateur radio and broadcast television frequencies. Since Mr. Pegler called it a "double-delta" antenna structure, hereinafter that term will be used.

Among the various shapes that have been proposed, mathematical analysis shows that some of the rectangles of Sykes produce higher gains than the squares of Wells. Unfortunately, in order to produce radiation patterns like FIG. 1B from this type of structure, the necessary high and narrow structure yields good performance over a rather small range of frequencies. Much better performance is available from the diamonds of Davey, but best of all of these structures is the combination of two triangles proposed by Pegler. Although the diamonds give a slightly greater bandwidth for a particular gain than do the triangles, this advantage comes with disadvantages. Compared to the triangle structures, the diamond structures are larger between the outer corners, require one more connection between the parts of each loop because there are four sides, and do not suppress the radiation in undesired directions as well. Indeed, in order to obtain a pattern like FIG. 1B, the diamond structures must be much larger than the triangle structures. In addition, it is easier to adjust the triangles because a computer program can specify the dimensions with sufficient accuracy so that only the lengths of two equal sides need adjustment on the antenna range.

Prior Art—Pairs of Triangles

Specifically, Pegler's antenna structure is the combination having a corner of each triangle at the central point, with the sides of the triangles opposite those corners disposed parallel to each other to form the outer sides of the structure. FIG. 3 illustrates such an antenna structure, in a modified form. Hereinafter in this description and the attached claims, these outer sides, 302 and 305, will be called the parallel conductors. The remaining sides of the triangles, 301, 303, 304 and 306, will be called the diagonal conductors. The generator symbol, 307, implies that the structure is connected to the associated electronic equipment at the central point. Hereinafter in this description and the attached claims, the term associated electronic equipment will refer to the kind of equipment usually attached to antennas. In addition to transmitters and receivers, the associated electronic equipment could be devices such as security equipment that use antennas to detect the presence of objects.

Because of the symmetry of the structure in FIG. 3, it is apparent that the currents in the two parallel conductors would be approximately equal in amplitude and phase. Therefore, they would aid each other in producing a signal in the direction perpendicular to the plane of the loops. As the structure is depicted in FIG. 3, this would be a vertically polarized signal. One also can see that the vertical components of the currents in the diagonal conductors might aid this vertically polarized signal, but the extent of this aid is unclear because there is no reason to believe that the currents near the central point are equal in amplitude or phase to the outer currents. It is apparent only that the currents in the diagonal conductors of one triangle would be approximately equal in amplitude and phase to the currents in the corresponding diagonal conductors of the other triangle, because of the symmetry. One can be more confident in observing that the horizontally polarized components of the radiation in the direction perpendicular to the plane of the loops would tend to cancel. This is because the symmetry of the structure suggests that the horizontal components of the currents in corresponding parts of the two loops would be flowing in opposing directions. What the radiation might be in other directions is too complicated to perceive just from FIG. 3. That is, the current paths of FIG. 3 suggest only that the structure should favor vertically polarized signals in the direction perpendicular to the plane of the loops.

The gain advantage of these triangular loops seems to be based on the need to separate the high-current parts of the structure by a relatively large distance. As it is with combinations of dipoles, for example, there is a requirement to space individual antennas by some minimum distance in order to achieve the maximum gain from the combination. The spacing of the high-current parts achieved by the rectangular loops of Sykes and Wells is less than it could be because not only are the outer sides high-current active parts but so also is the central side. Davey's diamonds separate those high-current outer parts to a greater degree, but that shape is not the best available. Triangular loops waste less of the available one-wavelength loop perimeter in placing the outer high-current parts far from the central point. Triangular loops also greatly reduce the radiation from the central high currents, because these currents are flowing in almost opposite directions into and out of the central corners. Therefore, as far as combinations of two loops approximately one wavelength in perimeter are concerned, these triangular shapes seem to produce the maximum gain available so far.

One modification of Pegler's antenna that is shown by FIG. 3 is that the diagonal conductors are curved. Although the Pegler version of this structure had straight diagonal conductors, mathematical analysis reveals that it is not a great change if they are curved by a moderate amount. Such curved diagonal conductors can produce right-angle connections between the various parts, which are often convenient. Of course, curved parts have more length than straight parts between the same points, so some adjustment will be needed in the length of the parts.

Since it is unlikely that the impedance of an antenna is the impedance needed at the end of the transmission line connected to it, some kind of matching system is usually used. FIG. 3 shows a T match applied to the double-delta antenna structure. Parts 307 and 308 match the right-hand loop, and parts 309 and 310 match the left-hand loop. Parts 311, 312, 313 and 314 are the shorting bars at the end of the T parts. Such a structure would be connected to the transmission line at the F points through an appropriate tuning device, usually two capacitors, and through a balanced-to-unbalanced transformer, if the transmission line were unbalanced. Except for the fact that there are two loops to match, this is all conventional practice.

At the central point, a supporting structure, 315, is illustrated in FIG. 3. It's significance to this discussion is to show that a conductive path is needed between the diagonal conductors at this point to complete this system of connection to the transmission line. Many conventional devices to support the structure would be satisfactory for this purpose. If it was desired to connect to the associated electronic equipment without the T match, part 315 would be replaced by the two connections to the alternate matching system.

As is true of many antennas, double-delta antenna structures can be made using solid rods or tubing of almost any cross-sectional shape or diameter, although the circular cross-section is usually preferred. FIG. 3 somewhat illustrates this by showing the diagonal conductors as tubing and the parallel conductors as solid rods of a smaller diameter. One would expect that a large double-delta antenna structure designed for the high-frequency spectrum, for example, would have parts of various diameters because more strength would be required near the central supporting structure than would be required at the outer parallel conductors. For the ultra-high-frequency spectrum, the small structure needed could be constructed entirely of conductors of the same size.

The actual dimensions of such structures would depend on the cross-sectional dimensions of the conductors being used and, like most antennas, some adjustment would be necessary. However, some guidance can be obtained from the dimensions of one such structure. In order to obtain a radiation pattern like FIG. 1B, one structure had parallel conductors approximately 0.33 free-space wavelengths long and there was approximately 0.68 free-space wavelengths between the parallel conductors. For a pattern like FIG. 1A, the parallel conductors would be longer and the distance between the parallel conductors would be shorter. On the other hand, for a pattern like FIG. 1C, the parallel conductors would be shorter and the distance between the parallel conductors would be longer.

It has been common to connect only side of this structure, the upper or lower side in FIG. 3, to the transmission line. That is, a dual gamma match instead of a dual T match has been used. Of course, this upsets the balance of the structure and produces a major lobe of radiation that is not quite perpendicular to the plane of the loops. It also produces unnecessarily large minor lobes because the undesired radiation is not cancelled very well. Therefore, although people have been satisfied with the dual gamma match, it is not the preferred matching system.

One also should note that although this structure appears superficially similar to a conical dipole, such as the one in Henry White's U.S. Pat. No. 2,615,005, the method of connecting it to the transmission line is radically different. The conical dipole is fed between one loop and the other loop. The double-delta antenna structure, and the other double-loop structures mentioned above, are fed between one side of both loops and the other side of both loops. This changes the current distribution and, therefore, the nature of these antennas.

Within many articles, Professor Takehiko Tsukiji and his colleagues at Fukuoka University have analyzed Pegler's antenna in, for example, Yagi-Uda arrays in I.E.E.E. Conference Publication 195 in 1981; in front of reflecting screens in *Electronics and Commnunications in Japan*, Vol. 68, No. 11, in 1985; and as parts of elliptically polarized arrays in the *Proceedings of The* 1985 *International Symposium on Antennas and Propagation*, in Japan. John Belrose disclosed the use of one-half of Pegler's antenna mounted on the ground in QST of April, 1983. One advantage of Pegler's antenna, as the Japanese researchers disclosed in their articles, is greater bandwidth as far as the terminal impedance is concerned. They also revealed the superior gain of such antennas if they are narrow and high instead of wide and short. Unfortunately, as is typical of antennas, the increased gain is accompanied by less bandwidth.

The Present Invention

Now that the prior art has been discussed and the merit of double-delta antenna structures has been established, a particular new use of these superior structures can be discussed. These antenna structures generally can be used in the way that half-wave dipoles are used, and Tsukiji and Belrose have disclosed some of the uses. The present invention is concerned with antennas for horizontally polarized omnidirectional service. For broadcasting or for networks of stations, a horizontally-polarized radiation pattern is often needed that is omnidirectional in the horizontal plane, instead of highly directional. To achieve this, an old antenna called a turnstile sometimes has been used. It has two half-wave dipole antennas positioned at right angles to each other and fed 90 degrees out of phase with each other. A problem with that antenna is that it has hardly any gain. "The Super Turnstile" antenna, which R. W. Masters disclosed in *Broadcast News* in January, 1946, produces almost twice the power gain of a turnstile array of dipoles. Unfortunately, the Masters antenna also produces more wind resistance because it is constructed of solid sheets of material or a grid of conducting material sufficiently dense to simulate solid sheets. That grid of conductors also makes the Masters antenna rather complicated.

Figure 4:
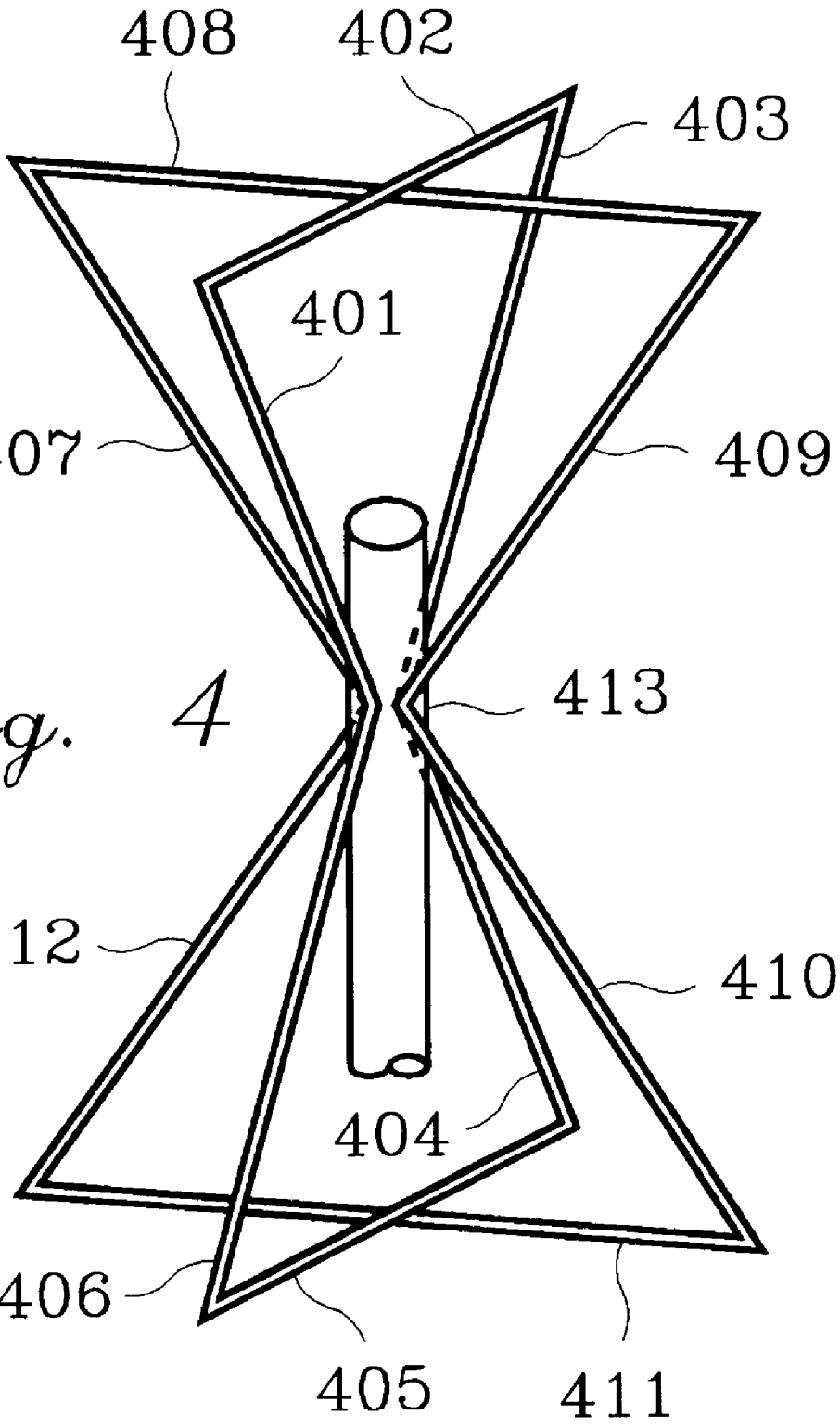
FIG. 4 illustrates a perspective view of a double-delta turnstile antenna, which is the subject of this disclosure.

FIG. 4 shows an equivalent arrangement of double-delta antenna structures that would serve the same purpose. Parts 401 to 406 form one double-delta antenna structure and parts 407 to 412 form the second one. Part 413 is the mast supporting the whole structure. The matching and phasing system would be similar to that required by similar arrays of half-wave dipoles, therefore it is not shown in this diagram to avoid unnecessary confusion. Such an array produces gain similar to that available from the Masters antenna but, since it is constructed with individual conductors instead of surfaces, it produces less wind resistance and complexity than the Masters antenna. This structure, which hereinafter will be called a double-delta turnstile antenna, is the subject of this disclosure.

Although the bandwidth of this antenna is good enough for most purposes, it is not as good as the superb bandwidth of the Masters antenna. Therefore, for applications involving wide-band signals, such as television broadcasting, the Masters antenna would be preferable in that respect. However, in some cases, the bandwidth of the double-delta array may be adequate even for television. For example, since the bandwidth as a percentage of the center frequency would be approximately constant for a particular type of antenna, the double-delta turnstile array is more likely to be adequate to cover a 6 MHz band for television at 500 MHz than a 6 MHz band at 50 MHz.

One problem with such wide-band signals is that the relationship between the parts of the signal may be important. Particularly, the phase relationship between the various frequencies in the signal may be important. On the other hand, for the parts of amateur-radio bands that use horizontal polarization, the bands are relatively narrow and the signals in those bands are very narrow. For such a service, the double-delta turnstile array would be preferred. Such an antenna would provide an adequate bandwidth and as much gain as provided by a Masters antenna, without the complexity and wind resistance of the Masters antenna. At the lower very-high frequencies or at the high frequencies, the size of the antenna could make the wind resistance a serious problem. Also serious would be the wind resistance of very-high-frequency antennas mounted on vehicles.

Of course, turnstile arrays could be made with three or more double-delta antennas structures, spaced physically and electrically by less than 90 degrees. For example, three structures could be spaced by 60 degrees. Such structures may produce a radiation pattern that is closer to being perfectly omnidirectional, but such an attempt at perfection would seldom be necessary. More useful might be two structures spaced physically and electrically by angles other than 90 degrees, with equal or unequal energy applied. Such an array would produce a somewhat directive pattern, which might be useful if coverage is needed more in some directions than in other directions.

While this invention has been described in detail, it is not restricted to the exact embodiments shown. These embodiments serve to illustrate some of the possible applications of the invention rather than to define the limitations of the invention.

I claim:

1. An antenna structure comprising two sets of conductors, such that:

(a) each of said two sets of conductors has two approximately parallel conductors, disposed approximately in a plane, which are separated from the proximal point of that particular set of conductors by approximately equal distances;

(b) in each of said two sets of conductors, the centers of said approximately parallel conductors and said proximal point are disposed so that they approximately describe an imaginary line which is perpendicular to said approximately parallel conductors;

(c) in each of said two sets of conductors, four diagonal conductors of approximately equal length, disposed in said plane, connect each end of said approximately parallel conductors to said proximal point, thereby producing two current paths that are approximately triangular;

(d) the dimensions of each of said two sets of conductors and the manner of connection to the associated electronic equipment are such that they produce current maxima in the conductors at approximately the centers of said approximately parallel conductors and at said proximal point, with single current minima between those maxima;

(e) said dimensions of each of said two sets of conductors and said manner of connection to said associated electronic equipment are such that the currents in said two approximately parallel conductors in each of said two sets of conductors are approximately equal in amplitude and phase;

(f) said dimensions of each of said two sets of conductors and said manner of connection to said associated electronic equipment are such that the currents in said diagonal conductors of one triangular current path, in each of said two sets of conductors, are approximately equal in amplitude and phase to the currents in the corresponding diagonal conductors of the other triangular current path;

(g) the two planes of said two sets of conductors are disposed approximately at right angles to each other;

(h) the imaginary lines described by the centers of said approximately parallel conductors and the proximal points of said two sets of conductors also are approximately the imaginary line described by the junction of said two planes of said two sets of conductors;

(i) said proximal points of said two sets of conductors are much nearer to each other than the length of the operating wavelength; and (j) said manner of connection to said associated electronic equipment is such that the currents in the corresponding conductors of said two sets of conductors are consistently related in amplitude by approximately the same ratio of values and are consistently unequal in phase by approximately the same amount.

2. The antenna structure of claim 1 wherein said manner of connection to said associated electronic equipment is such that the currents in said corresponding conductors of said two sets of conductors are approximately equal in amplitude and are consistently unequal in phase by approximately 90 degrees.

3. The antenna structure of claim 1 wherein said dimensions of each of said two sets of conductors maximize the performance of said antenna structure in the plane that is perpendicular to both of said planes of said two sets of conductors.

4. The antenna structure of claim 1 wherein said dimensions of each of said two sets of conductors minimize the performance of said antenna structure in the two directions that are parallel with the junction of said planes of said two sets of conductors.

5. The antenna structure of claim 1 wherein said dimensions of each of said two sets of conductors produce a beneficial compromise between maximizing the performance of said antenna structure in said plane that is perpendicular to both of said planes of said two sets of conductors while minimizing such performance in other directions.

6. The antenna structure of claim 1 wherein at least one of the conductors has a solid cross-sectional area.

7. The antenna structure of claim 1 wherein at least one of the conductors is tubular.

8. The antenna structure of claim 1 wherein all the conductors have the same cross-sectional areas.

9. The antenna structure of claim 1 wherein the conductors are not all of the same cross-sectional area.

10. The antenna structure of claim 1 wherein all of the conductors are approximately straight.

11. The antenna structure of claim 1 wherein at least one of the conductors is somewhat curved.

12. The antenna structure of claim 1 wherein said approximately parallel conductors are disposed approximately parallel to the ground.

* * * * *